United States Patent [19]

Kollman

[11] 4,014,282

[45] Mar. 29, 1977

[54] EXHAUST TUBE MOUNTING APPARATUS FOR OUTBOARD MOTORS

[75] Inventor: Delhardt K. Kollman, Oshkosh, Wis.

[73] Assignee: Brunswick Corporation, Skokie, Ill.

[22] Filed: Sept. 4, 1975

[21] Appl. No.: 610,305

[52] U.S. Cl. ..... 115/.5 E; 60/310; 115/17

[51] Int. Cl.[2] ..... B63H 21/34

[58] Field of Search ..... 115/17, 18 R, .5 E; 60/310, 311, 312, 313, 314; 277/205

[56] References Cited

UNITED STATES PATENTS

| | | | |
|---|---|---|---|
| 3,045,423 | 7/1962 | Hulsebus | 115/17 |
| 3,127,866 | 4/1964 | Mohr | 115/17 |
| 3,198,162 | 8/1965 | Larsen | 115/17 |
| 3,310,022 | 3/1967 | Kollman | 115/17 |
| 3,577,952 | 5/1971 | Tado | 115/17 |

*Primary Examiner*—Stephen G. Kunin
*Assistant Examiner*—Charles E. Frankfort
*Attorney, Agent, or Firm*—Andrus, Sceales, Starke & Sawall

[57] ABSTRACT

In an outboard motor, the engine exhausts through the drive shaft housing in which an exhaust tube directs the gases into a lower propeller unit secured to the housing. The exhaust tube has support lugs on the opposite top sides. Bushings encircle each lug and they rest in receptacles on the upper interior portions of the housing. An adapter plate is secured to the housing, clamps the lugs in place and moves the lower end of the tube into sealing relationship within a lower bushing within the housing. The lower bushing is a rubber-like annular bushing having a projecting ledge aligned with the lower end of the exhaust tube. The inner wall of the bushing has an inwardly and downwardly extended lip deflected and sealing with the side of the exhaust tube.

11 Claims, 7 Drawing Figures

EXHAUST TUBE MOUNTING APPARATUS FOR OUTBOARD MOTORS

BACKGROUND OF THE INVENTION

This invention relates to an exhaust tube mounting apparatus for an outboard motor.

In outboard motors, a powerhead is secured to the upper end of a drive shaft housing and a lower propeller unit is secured to the lower end of the drive shaft housing. Generally, the engine exhaust is directed downwardly through a tube system within the drive shaft housing to discharge the exhaust gases at or beneath the waterline, and preferably through the propeller unit. For higher horsepower engines, a pair of exhaust tuning pipes will be secured to the powerhead for the banks of alternately fired cylinders and each extended downwardly into the drive shaft housing. An exhaust tube is generally secured in sealed relationship extended through the drive shaft housing to direct the exhaust gases downwardly to the lower unit, to separate the exhaust passageway from the other components within the drive shaft housing and the like.

The exhaust tube defines an expansion chamber within which the tuning exhaust pipes terminate and around which a cooling and sound deadening water area may circulate. Thus, normally a water cooling tube, as well as a shift mechanism may be located within the drive shaft housing for coupling between the various functional components.

The exhaust tube has generally been extended through the upper end of the drive shaft housing structure and secured to the lower adapter plate. The lower end of the exhaust tube extends downwardly from the drive shaft housing into sealing engagement with a suitable sealing retainer means in the lower propellor unit. Although such structures provide a completely satisfactory functional system, the lower unit must be very carefully interconnected to the drive shaft housing to ensure the necessary alignment for establishing a firm and reliable sealing of the exhaust tube to the discharge passageway in the lower unit.

SUMMARY OF THE INVENTION

The present invention is particularly directed to a simple and inexpensive mounting of the exhaust insert or tube within the drive shaft housing in such a manner as to permit the direct mounting of the several components including the lower unit with a positive sealing of the input within the exhaust or drive shaft housing.

Generally, in accordance with the teaching of the present invention the exhaust insert or tube is completely mounted within the drive shaft housing with a notch and projection locating connection means interconnecting the upper end of the exhaust tube to the drive shaft housing. The lower end of the tube is aligned with and engages a resilient lower mount which preferably includes suitable deflecting means to assist in the location of the lower end of the exhaust tube within the lower end of the drive shaft housing. In the assembly, the exhaust tube in located is in the drive shaft housing. The adapted plate is bolted or otherwise attached to the upper end of the housing and exerts a downward pressure on the tube and particularly the upper locating connection means to firmly interconnect the tube at the upper end and to simultaneously force the lower end downwardly into the resilient gasket or mount to establish a firm support of the lower end of the tube in proper alignment to the attachment means for the lower unit. The lower unit may then be readily interconnected to the lower end of the exhaust housing exerting a positive force on the lower face or end of the resilient mount to firmly support the lower end of the exhaust tube in appropriate alignment with the exhaust passageway in the lower unit.

In a particular and preferred construction the bottom resilient member is a rubber-like annular bushing which is seated within an opening in the bottom wall of the drive shaft housing. The inner wall of the bushing includes a small inwardly projecting ledge providing a small interference fit with the lower end of the exhaust tube. The annular bushing projects upwardly between the exterior of the tube and the supporting wall within the drive shaft housing. The inner wall of the bushing is further formed with an inwardly and downwardly extended lip which is deflected outwardly by the exhaust tube as it moves into the bushing.

The upper end of the exhaust tube is provided on the opposite side with corresponding lugs such as generally rectangular extensions. Suitable rubber-like bushings encircle each extension. The uppermost end of the drive shaft housing is provided with a pair of upwardly and outwardly opening receptacles or recesses adapted to accommodate the covered lugs. The assembly is such that the covered bushings and particularly the upper surface will project upwardly slightly above the uppermost edge of the drive shaft housing. When the adapter plate is secured to the drive shaft housing, the flange rests on the covered lugs and forces the exhaust tube downwardly with the lower end moving into sealing relationship within the lower annular rubber mount or bushing.

Thus, the lower unit is provided with an opening essentially positioned to align with the lower end of the exhaust tube. The elimination of any interfering projecting coupling between the lower unit and the exhaust tube, however, significantly minimizes the difficulty of assembly without in anyway interfering with the effectiveness of the exhaust passageway.

The present invention has been found to provide a simple, reliable and inexpensive mounting of the exhaust tube while eliminating the necessity of any interconnection or special alignment between the lower unit and the drive shaft housing.

BRIEF DESCRIPTION OF THE DRAWING

The drawing furnished herewith illustrates a preferred construction of the present invention in which the above advantages and features are clearly disclosed as well as others which will be readily understood from the following description.

In the drawing.

DESCRIPTION OF THE PREFERRED EMBODIMENT

Figure 1:
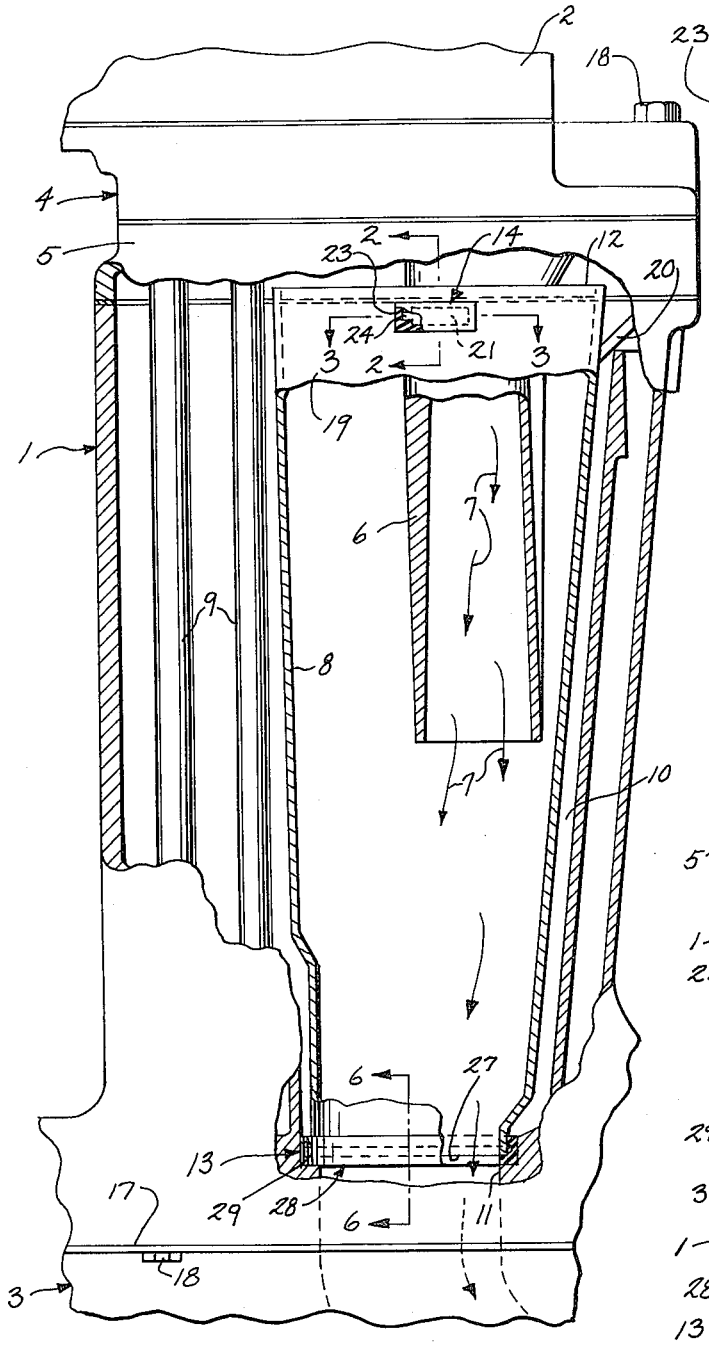
FIG. 1 is a fragmentary, side elevational view of a drive shaft housing and lower unit of an outboard motor, with parts broken away and sectioned to show inner details of construction.

Referring to the drawing and particularly to FIG. 1, a fragmentary portion of an outboard unit is illustrated particularly including the drive shaft housing 1 which supports a powerhead 2 at the upper end and a lower propeller unit 3 at the bottom end. Upper and lower adapter plates 4 and 5 and interposed between the powerhead 2 and the drive shaft housing 1 provided with various interconnecting cooling and exhaust passageways for the outboard motor apparatus. Generally, a suitable swivel bracket and steering assembly, not shown, will be interconnected to housing to swivelly support the outboard motor in the aft end of a boat, not shown.

The powerhead 2 includes a suitable engine with an exhaust system extended downwardly through housing 1. In multiple cylinder high horsepower engines individual tuned passageways are provided including exhaust manifolds for exhausting interrelated cylinders downwardly through the discharge housing 1. Generally, a suitable dual exhaust pipe 6 is secured within the adapter plates 4 and 5 and extends downwardly into the drive shaft housing 1. The length of the exhaust pipe 6 is selected to effectively tune the engine for selected operating speeds for outboard motor operation. The exhaust gases 7 are directed downwardly and are exhausted through a passageway in the lower propeller unit 3, in accordance with conventional modern practice. An exhaust tube or insert 8 is also conventionally provided extending through drive shaft housing 1 to separate the exhaust gases 7 from the surrounding components within the drive shaft housing such as a drive shaft and water inlet tube 9 and the like. The tube 8 also defines a water cooling jacket 10 through which the engine cooling water is normally passed to form a sound and cooling barrier.

The lower end of tube 8 is aligned with the upper end of the discharge passageway 11 in the lower unit 3 by the assembly 13 to discharge the gases through the lower unit.

The particular construction of the powerhead 2 and the lower unit 3 as well as individual internal construction of the adapter plates 4 and 5 is not of particular significance in the present application and consequently no further description thereof if given other than as necessary to fully describe the present invention.

The present invention is particularly directed to the method of mounting the exhaust tube 8 and consequently the construction thereof is more fully shown in FIGS. 2 – 6 and described in detail with reference to the other portions of the unit referred to, to clearly explain the present invention.

The exhaust tube 8 of the present invention is a tubular member which extends throughout the length of the drive shaft housing 1 with the upper end projecting slightly upwardly into the lower adapter plate 5 as at 12 and with the lower end terminating within a novel annular mount assembly 13 within the lower end of the drive shaft housing 1. The upper end of the exhaust tube 8 is mounted with receptable and projection mount assemblies 14 and 15 provided on the opposite sides of the exhaust tube 8. The tube 8 is firmly clamped and resiliently mounted within the upper end drive shaft housing 1 by the assemblies 14 and 15 as a result of the interconnection of the adapter plate 5 to the upper mounting flange 16 of drive shaft housing 1 and the lower unit 3 to the lower mounting flange 17 of drive shaft housing 1 by suitable bolt means 18.

More particularly, the exhaust tube 8 has a generally rectangular cross section with a back wall somewhat narrower than the front wall and interconnected thereto by angularly oriented sidewalls 19 including the mount assemblies 14 and 15. The upper end of the tube 12 projects upwardly into the adapter plate 5, with the aft end having a flared portion 20 projecting outwardly into engagement with the outer wall of the adapter plate with the mount assemblies 14 and 15 spaced slightly downwardly from the upper edge 12.

Each of the assemblies 14 and 15 is similarly constructed and assembly 14 is particularly described. Generally, the assembly 14 includes a projecting lug 21 secured to the extension of the tube 8 and a receptacle 22 secured to the interior sidewall of housing 1.

Figure 2:
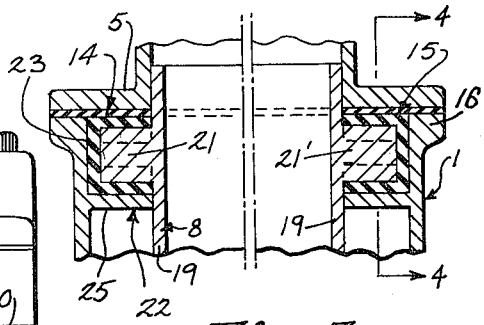
FIG. 2 is an enlarged vertical section taken generally on line 2 — 2 of FIG. 1.
Figure 3:
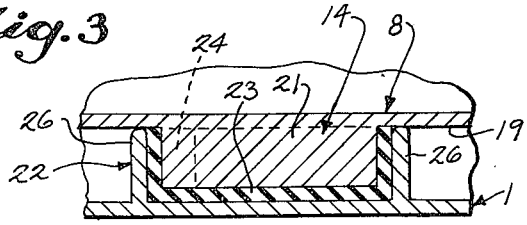
FIG. 3 is a horizontal section taken generally on line 3 — 3 of FIG. 1.
Figure 6:
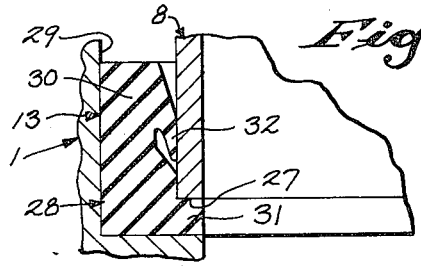
FIG. 6 is a view on line 6—6 of FIG. 1.

More particularly, as shown in FIGS. 1 – 3 the lug 21 is a bar-like projection welded or otherwise integrally cast in the sidewall of the tube 8 and located below the uppermost end by the distance the exhaust tube 8 extends into plate 5. A rubber-like gasket or bushing 23 is located over the lug 21 which may be provided with a reduced end 24 interlocking with a corresponding end of the bushing 23.

Figure 5:
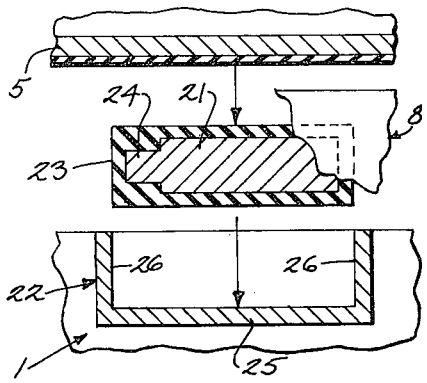
FIG. 5 is an exploded fragmentary view illustrating assembly of the upper end of the exhaust tube.

The uppermost end or mounting flange 16 of the drive shaft housing 1 is provided with the upwardly and inwardly opening receptacle 22 integrally cast or otherwise interconnected to the interior sidewall of the housing 1. The receptacle 22 thus has a base wall 25 and a pair of sidewalls 26 defining a U-shaped member complementing the covered lug 21. As shown in FIG. 5, with the adapter plate 5 removed, the resilient covering or bushing 23 locates the tube 8 with the upper portion of bushing 23 slightly above the uppermost mounting surface of the receptacle 22 and the housing mounting flange 16. When the adapter plate 5 is bolted to the flange 16, the plate 5 compresses the bushing 23 and resiliently forces the lug downwardly into the receptacle 22 such that the assemblies 14 and 15 establish a firm mechanical interconnection of the upper end to opposite sides of the exhaust tube 8 to the adjacent drive shaft housing 1.

The lower annular mount assembly 13 is adapted to receive the lowermost end of the exhaust tube 8 which in the illustrated embodiment is formed with a reduced opening of a generally rectangular configuration terminating in a lower planar edge 27. In the illustrated embodiment of the invention, the assembly 13 includes an annular bushing member 28 formed of a rubber-like material and fitted with an interference fit within a correspondingly shaped recess 29 in an exhaust opening in the bottom wall of the drive shaft housing 1.

Figure 4:
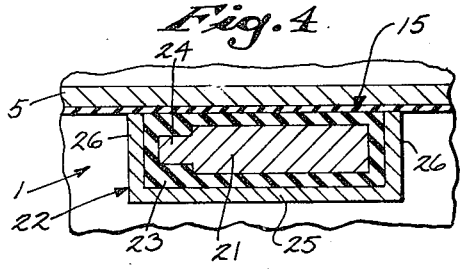
FIG. 4 is an enlarged vertical section taken generally on line 4 — 4 of FIG. 2.
Figure 7:
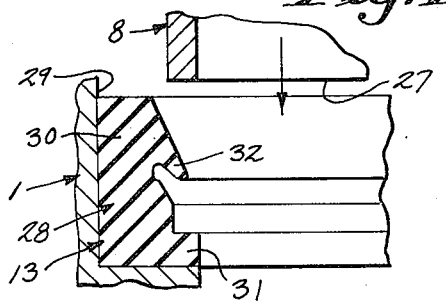
FIG. 7 is an exploded fragmentary view illustrating assembly of the lower end of the exhaust tube.

The bushing member 28 in particular, is a slightly L-shaped annular member having a heavy body portion 30 which projects upwardly between the lower wall opening 29 of the drive shaft housing 1 and the lowermost end of the exhaust tube 8. The member 28 includes inwardly projecting lip 31 extending beneath the lower edge 27 of tube 8 and of a depth generally corresponding to the thickness of the wall of exhaust tube 8 as shown in FIG. 4. The body portion 30 of the member 38 is formed with a deflectible rubber-like resilient lip 32 spaced upwardly from the lip 31. Lip 32 is deflected by the downward projection of the exhaust tube 8 to provide a positive and reliable seal at the interconnection of the lower end of the tube 8 to the drive shaft housing 1.

The lower end of the housing 1 and the member 28 abut the upper mounting flange wall 33 of the lower propeller unit 3. The tube 8 and the mount member 28 are thus contained within the exhaust housing 1 and can be readily assembled.

Thus, in assembly, the exhaust tube 8 is assembled to housing 1 with the lugs 21 resting in the receptacles 22 as shown in FIG. 5. When the adapter plate 5 is attached the tube 8 is forced downwardly into the bushing 28, with the lip 32 deflecting outwardly. The lower unit 3 is then bolted to the lower extended portion of the housing 1. The mounting apparatus has been found to provide a reliable support of the tube with the assembly thereof readily and conveniently provided.

Various modes of carrying out the invention are contemplated as being within the scope of the following claims, particularly pointing out and distinctly claiming the subject matter which is regarded as the invention.

I claim:

1. In an outboard motor having a power head attached to the upper end of a drive shaft housing and a lower propeller unit attached to the lower end of the drive shaft housing, said drive shaft housing having a bottom discharge opening in the lower end thereof, an exhaust tube mounted in said drive shaft housing with the lower end located within said drive shaft housing and in alignment with the discharge opening of said drive shaft housing, the upper end of the exhaust tube and the drive shaft housing having mating projections and receptacles, said drive shaft housing including a horizontal support wall upon which the exhaust tube rests to support the upper end of the exhaust tube on the drive shaft housing, said powerhead having means resting on said exhaust tube and clamping said tube to said support wall, and a resilient mount secured within said discharge opening and locating the lower end of the exhaust tube in upwardly spaced relation to the lower propeller unit.

2. In the outboard motor of claim 1 wherein said resilient mount includes a portion located between the lower edge of the exhaust tube at the lower end of the drive shaft housing.

3. The outboard motor of claim 1 wherein said resilient mount is an annular member formed of an integral rubber-like material, said member being firmly affixed within the drive shaft housing, said annular member having a body portion extending upwardly along the side of the exhaust tube, a sealing ledge being integrally formed on the lower inner wall of said body portion, a deflectable lip on said inner wall in upwardly spaced relation to said ledge, said lip being deflected with the tube engaging said ledge.

4. The outboard motor apparatus of claim 1 having resilient means encircling said projections.

5. In an outboard motor apparatus having a power head means attached to an upper mounting flange portion of a drive shaft housing and a lower propeller unit attached to a bottom mounting flange at the lower end of the drive shaft housing, said drive shaft housing having a bottom discharge opening in the bottom mounting flange of the drive shaft housing, an exhaust tube mounted in the drive shaft housing with the upper end projecting above the upper mounting flange portion of said drive shaft housing and the lower end located in alignment with the bottom discharge opening of the drive shaft housing, a resilient mount secured within said discharge opening, said resilient mount resiliently gripping the lower end of the exhaust tube and having a lower ledge portion located between the lower edge of the exhaust tube at the lower mounting flange of the drive shaft housing, the upper end of the exhaust tube having outward projecting lugs on opposite sides of the tube, said drive shaft housing having corresponding receptacles on the opposite sides of the housing, said exhaust tube projections being clamped into the receptacles by the upper power head means.

6. The outboard motor apparatus of claim 5 wherein a resilient means is located between the projections and the receptacle and the power head means.

7. The outboard motor apparatus of claim 5 wherein said resilient mount is an annular member formed of an integral rubber-like material, said member being firmly affixed within the discharge opening in the drive shaft housing, said annular member having a body portion extending upwardly between the exhaust tube and the supporting discharge opening in the drive shaft housing, a ledge being integrally formed on the lower inner wall of said body portion with the bottom surface generally coplanar with the lower mounting flange, and a deflectable portion on said inner wall being deflected with the tube engaging said ledge.

8. In the outboard motor apparatus of claim 7 wherein said deflectable portion is a lip spaced upwardly from the ledge.

9. In the outboard motor apparatus of claim 5 wherein said projecting lugs are generally rectangular and have a reduced end, an encircling resilient bushing on said projecting lugs, said receptacles are generally upwardly opening U-shaped member extending laterally from the wall of the drive shaft housing.

10. The outboard motor apparatus of claim 9 wherein said resilient mount is an annular member formed of an integral rubber-like material, said member being firmly affixed within the discharge opening in the drive shaft housing, said annular member having body portion extending upwardly between the exhaust tube and the supporting discharge opening in the drive shaft housing, said ledge being integrally formed on the lower inner wall of said body portion with the bottom surface generally coplanar with the lower mounting flange, and a deflectable lip on said inner wall in upwardly spaced relation to the ledge, said lip being deflected with the tube engaging said ledge.

11. In an outboard motor having a power head attached to the upper end of a drive shaft housing and a lower propellor unit attached to the lower end of the drive shaft housing, said drive shaft housing having a bottom discharge opening in the lower end thereof, an exhaust tube mounted in the drive shaft housing with the lower end located within the drive shaft housing and in alignment with the discharge opening of the drive shaft housing, the upper end of the exhaust tube and the drive shaft housing having mating projections and receptacles to support the upper end of the exhaust tube on the drive shaft housing, a resilient mount secured within said discharge opening and locating the lower end of the exhaust tube in upwardly spaced relation to the lower propellor unit, said mount including an annular resilient member formed of an integral rubber-like material, said member being affixed within the discharge opening and having a body portion extending upwardly along the side of the exhaust tube, a sealing ledge being integrally formed on the lower inner wall of said body portion, a deflectable lip on said inner wall in upwardly spaced relation to said ledge, said lip being deflected with the tube engaging said ledge.

* * * * *